United States Patent [19]

Le Cain et al.

[11] 4,063,127

[45] Dec. 13, 1977

[54] OVERLOAD PROTECTION TUBE

[75] Inventors: Yves Dominique Le Cain, Le Chesnay; Ali Nagati, Massy; Bruno A. F. Pellet, Levallois, all of France

[73] Assignee: International Standard Electric Corporation, New York, N.Y.

[21] Appl. No.: 698,393

[22] Filed: June 21, 1976

[51] Int. Cl.[2] ..... H01J 17/00; H01J 21/00

[52] U.S. Cl. ..... 313/325; 313/151; 313/214; 361/120; 313/231.1

[58] Field of Search ..... 313/325, 214, 151, 232.1; 317/66; 361/120

[56] References Cited

U.S. PATENT DOCUMENTS

| | | | |
|---|---|---|---|
| 1,696,157 | 12/1928 | Flarsheim | 313/151 X |
| 2,481,298 | 9/1949 | Eldridge, Jr. | 313/151 X |
| 2,990,492 | 6/1961 | Wellinger et al. | 313/325 X |
| 3,289,027 | 11/1966 | Jones | 313/231.1 |
| 3,324,335 | 6/1967 | Simko | 313/325 X |
| 3,896,343 | 7/1975 | Baker et al. | 313/231.1 |

*Primary Examiner*—Saxfield Chatmon, Jr.
*Attorney, Agent, or Firm*—John T. O'Halloran; Jeffrey P. Morris

[57] ABSTRACT

A reliable overload protection tube utilizes a meltable sealing material to mount an electrode within a metallic enclosure. The interelectrode gap between the tube electrodes is adjusted to determine the desired tube breakdown voltage. Voltage in excess of breakdown ionizes the tube and conducts the overload current safely to ground. The sealing material upon excess overload current becomes heated and melted allowing the electrodes to move into a short circuit contact to ground.

7 Claims, 1 Drawing Figure

OVERLOAD PROTECTION TUBE

FIELD OF THE INVENTION

The present invention relates to overload protective devices for avoiding damage to circuits or electrical installations which may be subject to overloads.

BACKGROUND OF THE INVENTION

It is obligatory to provide general or special electrical installations with protective devices to avoid the deleterious effects of overload for which these installations are not designed. These common protective devices are known as fuses, overvoltage protection tubes, lightning protection tubes and other similar names. Their purpose is to prevent transmitting an overload dangerous for a given type of installation.

The application of this type of protective device is of particular importance in the case of telephone installations, circuits and exchanges. Exchanges and the telephone lines are extremely vulnerable to lightning as well as to electrical stresses caused by induced overvoltages or to overloads caused by accidental contact between a power line and telephone line. Telephone exchanges have been completely destroyed after being struck by lightning or by overload due to the causes mentioned above.

In order to meet the requirement for protecting telephone circuits and exchanges, it has become necessary to connect a protective device, of the type commonly known as a lightning-protector, between each line and ground. The required charactersitics of this protective device are to cause no loss under normal operating conditions of the line, i.e. to present infinite resistance to current flow, and on the other hand to withstand and conduct to ground any transient overload. The lightning arrestor presents therefore a resistance which is always less than that of the circuit to be protected while maintaining a high current-carrying capacity above a predetermine voltage level.

Below a particular voltage designated as the striking voltage, a discharge tube presents infinite resistance, whereas for voltages across its terminals greater than the striking voltage the tube discharges to provide a low resistance. The tube is able to withstand high voltage overload, providing it has sufficient structure, by conducting these overloads to ground. The striking voltage value is easily predetermined by adjusting the dimensions of the tube discharge space. The current-carrying capacity is determined by the tube structure.

The manufacturer can therefore predetermined the various operating characteristics of the tube, which is a favorable factor for the use of a lightning-protector discharge tube.

Requirements are very stringent for the safety and reliability of telephone lines and circuits. In particular, one requirement for the parallel-connected protective device is that the latter forms a short-circuit whenever it becomes defective. If this requirement is not satisfied, nothing indicates failure of the protective device and the line would be destroyed by the first occurring overload. This can be avoided only by requiring the component to indicate its own failure. In this case, since the line then no longer operates, it becomes necessary to correct its defective protection by changing the faulty component in order to restore the line to normal operation. It is for this reason that the component must present a dead short-circuit when it can no longer perform its function, whatever the cause of failure. Grounding of the line makes it necessary to change the defective protection device.

In order to fulfill these conditions, this invention proposes a discharge tube characterized by the fact that is structurally possesses the means for automatically producing a short-circuit as soon as it is no longer able to operate in the normal discharge mode for any reason whatsoever.

SUMMARY OF THE INVENTION

In order to meet this requirement of producing a short-circuit in the event of failure in a discharge tube which contains a rarified gaseous atmosphere inside a sealed enclosure and at least two discharge electrodes whose ends are separated by a discharge gap of predetermined length corresponding to the establishment of a discharge for a striking voltage $V_o$ and whose structure is designed to withstand an internal operating temperature T lying between an upper limit $T_F$ and a lower limit $T_L$, the invention proposes internal means whereby the enclosure wall seal is of a material whose softening temperature is close to the upper temperature limit $T_L$.

According to the invention, the structure of the tube automatically produces a short-circuit in the event of failure due to any cause, since internal heating causes the temperature limit $T_L$ to become exceeded. When the aforementioned seal material reaches its softening temperature, the electrode itself is no longer rigidly held and is drawn into the tube by the difference in pressure between the outside atmospheric pressure and the lower internal pressure, such that the electrode comes into contact with the free end of the opposite electrode. The discharge gap is thus closed and the safety device becomes short-circuited.

Other characteristics of the invention will emerge from the detailed description below. It should be understood that the description and drawing are given as examples only and in no way limit the scope of the invention.

DESCRIPTION OF THE PREFERRED EMBODIMENT

Figure 1:
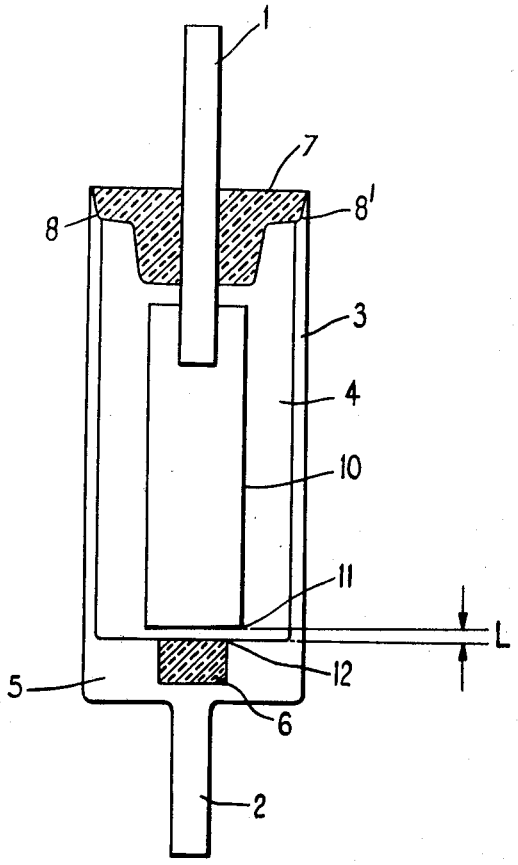
FIG. 1 is a logitudinal cross-section of a cylindrical discharge tube according to the invention.

FIGURE 1 shows the discharge electrodes 1 and 2 mounted through the enclosure 3, 7. In the form shown here, this sealed enclosure possesses a metallic part forming the side wall 3 and the base 5 of the enclosure, and a part 7, forming a plug, made of electrically insulating material selected to provide a sealed bond with wall 3. Electrode 1 traverses the enclosure through a sealed traverse in the insulating material 7. This insulating material 7 is bonded to the metallic material of the enclosure round its edge, which seats on the internal edge 8, 8' of the side wall 3. This edge may be shouldered.

Electrode 1 is attached to a heavy extension 10 just beneath the inside surface of its traverse. The internal end 10 of electrode 1 and 12 of electrode 2, the latter being part of the base 5, are separated by a gap 11–12 of length L. A recess 6 is provided in the center of the wide part of electrode 2. This recess 6 may be filled with emissive material.

The external parts 1 and 2 of the discharge electrodes are, for example, in the form of pins, whose lengths and shapes enable them to fit into the special contact clips holding the device.

The metallic part 3 of the enclosure is made of metal which is a good electrical and thermal conductor, such as Dilver, aluminum, copper, etc. The insulating material providing the double bond between the enclosure and the first electrode 1 is, for example, of vitreous material. Electrode 1 is made of Dilver, and the vitreous material is a glass which bonds to Dilver.

Electrode 2 forming part of the enclosure is of solid metal.

An emissive mixture of barium, zirconium and aluminum is placed in the recess in electrode 2 before the tube is sealed.

When the tube is sealed, it is first pumped out and then filled with an inert atmosphere at a pressure less than ambient, with insertion of the emissive material. In the present case, the inert atmosphere is a mixture of rare gases: argon and helium. The internal pressure is 0.3 atmospheres. When the gas filling reaches this pressure, the plug 7, already carrying the metal-to-glass bonded electrode, is bonded to the enclosure. The depth to which this first electrode is inserted is adjusted when bonding this plug, such that the gap corresponds to the predetermined striking voltage of the tube, $V_o$. This gap thus determines the maximum voltage to be withstood by the circuits or lines to be protected. In the example described, the gap length $L = 0.3$ mm, and the voltage $V_o$ is 200 V.

The tube is then complete and ready to operate.

With regard to operation, normal operation is first described, followed by a description of the conditions under which the tube may deteriorate in abnormal circumstances.

In normal operation, the discharge tube operates as any other discharge tube, i.e. it is inert as long as the voltage across its terminals is less than the striking voltage.

As described above, the striking voltage is determined during the construction of the tube by the gap 11–12 between the electrodes.

When the voltage across the terminals of the discharge tube reaches the striking voltage $V_o$ the discharge is established.

Since the tube possesses fairly heavy electrodes (the heavy extension 10 for electrode 1, and the base 5 for electrode 2), it can withstand large currents which are conducted to ground. The tube can conduct a current I of several amperes for a time T (seconds) less than or equal to 50/I, before its temperature reaches the predetermined value $T_L$. In the case of a transient current, the current which can be carried under the same temperature conditions may be some thousand times higher, and depends on the pulse shape and the periods between pulses.

If the tube is placed under abnormal operating conditions, it produces a short-circuit. Operation becomes abnormal when the incident overload considerably exceeds the current-carrying capacity intended by the manufacturer when producing the tube, or when the tube itself fails. This failure may be due to a mechanical accident, expended emissive material, deterioration of the tube, or any other cause.

Abnormal operation of the tube inevitably produces abnormal heating. The internal temperature of the tube reaches and exceeds the limiting temperature $T_L$ predetermined by its construction.

In all cases, when the insulating material 7 reaches its softening temperature, the whole of the material 7 constituting the enclosure plug loses its rigidity. Since the internal pressure is less than the ambient pressure, the softened material collapses and is drawn inside, taking with it electrode 1 which it holds. The movement of the electrode closes the interelectrode gap 11–12, thereby short-circuiting the electrode ends 11 and 12. In this context, a short-circuit is any contact whose ohmic resistance is less than 0.02 ohms.

The discharge tube made according to the invention thus presents infinite resistance when the voltage across its terminals is less than a protection level $V_o$, and a very low resistance enabling it to conduct very high currents for the dimensions of the device when the voltage across its terminals reaches the value $V_o$. In the practical example described, the enclosure 3 has a length of only 11 mm and a diameter of 4 mm. The tube is able to conduct currents of 5 to 10 A DC, in which case the residual voltage across the tube terminals is 8 to 12 V. The tube can also conduct pulses of current reaching peak values of 5000 A (8/20 wave), occurring at intervals of 25 to 30 seconds between two consecutive shock waves.

The device is rendered unserviceable by a permanent current of 10 to 20 A at 50 Hz.

Destruction of the tube automatically short-circuits the electrodes for any reason producing abnormal discharge operation.

Systematic testing of several hundred production parts has demonstrated that the rule applied to 100% of the samples tested.

The advantages of the described protective device are therefore ensured protection at a well defined voltage level, since the value of this level is easily predetermined by adjusting the electrode gap during the manufacture of each type of lightning-protector, guaranteed automatic self-destruction of the tube resulting in dead short-circuiting of the electrodes with virtually mathematical accuracy for all components, the conduction of heavy overloads for very small dimensions of the component, easily reproducible manufacture during production because of the choice of its dimensions, and the simplicity of its parts and the small number of manual operations required.

With regard to manufacture, the main operations consist in various metal-to-metal welds, such as that between electrode 1 and its extension 10, metal-to-glass bonds between electrode 1 and the material of plug 7 and between the said plug 7 and the internal wall of the enclosure 3, and pumping out and gas filling.

Machining operations are also limited to machining of the circular edge or shoulder 8 inside the edge of the enclosure wall 3, machining of the recess 6, etc.

The ruggedness of the device subjected to high overloads is not only due to the arrangement of its heavy electrodes described about, but also to the fact that its enclosure is metallic, facilitating thermal dissipation during operation.

The component is practically uninflammable.

The dimensions and shapes of the practical component described are in no way limiting. Any person skilled in the art is able to conceive many other practical shapes of the enclosure or electrodes for practical application of the invention without going beyond the scope of the invention.

In particular, other shapes may be given to the vitreous plug, as well as to the enclosure which together with said plug provides the sealing of the discharge tube and the safe destruction of the tube by short-circuiting the electrodes. Instead of a shoulder 8 on the inside edge of the enclosure, another profile may be used to facilitate the bonding of the plug to the edge.

In order to improve electrode contact when the tube is destroyed, it is possible to provide a coating on at least one electrode end or on the base of the enclosure opposite the other electrode. The coating can consist of a conducting material whose melting point is close to the limiting operating temperature. When heating occurs due to abnormal operation, the softened plug releases the electrode it carries, allowing it to move towards the opposite electrode, and the coating material then changes its physical state, thereby "wetting" the opposite surface, ensuring improved cohesion when the electrodes come into contact.

The choice of coating material depends on the imposed temperature limit and results from the intended practical application. Any method may be used for depositing the coating. The coating may be applied to the top surface of the enclosure base 5.

Although the principles of the present invention are described above in relation with specific practical examples, it should be clearly understood that the description is given as an example only and does not limit the scope of the invention.

What is claimed is:

1. An overload protection discharge tube comprising an enclosure, an opening in the enclosure, a first electrode extending through said opening and having a first discharge surface inside said enclosure, a plug between said first electrode and said enclosure to hermetically seal said opening onto said first electrode, a second electrode having a second discharge surface inside said enclosure facing said first discharge surface and being separated from said first discharge surface by a discharge gap, and a gas atmosphere filling said enclosure at a pressure lower than atmospheric pressure, wherein said plug is comprised of a material which will soften at a temperature lower than the softening temperatures of the other portions of said discharge tube to enable the atmospheric pressure to drive said first electrode until said first discharge surface comes in contact with said second discharge surface, when said discharge tube is overheated due to abnormal operating conditions.

2. An overload protection discharge tube in accordance with claim 1 wherein said plug is comprised of an electrically insulating material.

3. An overload protection discharge tube in accordance with claim 2 wherein said enclosure is comprised of a material which is both electrically conductive and heat conductive.

4. An overload protection discharge tube in accordance with claim 1 wherein said opening includes a shoulder to support said plug.

5. An overload protection discharge tube in accordance with claim 1 wherein one of said electrodes includes a portion made of an emissive substance.

6. An overload protection discharge tube in accordance with claim 5 wherein said electrode including said emissive substance comprises a recess provided in said discharge surface, said recess being filled with said emissive substance.

7. A process for manufacturing an overload-protection discharge tube including an enclosure, an opening in the enclosure, a first electrode extending through said opening and having a first discharge surface inside said enclosure, a plug between said first electrode and said enclosure to hermetically seal said opening onto said first electrode, a second electrode having a second discharge surface inside said enclosure facing said first discharge surface and being separated from said first discharge surface by a discharge gap, and a gas atmosphere filling said enclosure at a pressure lower than atmospheric pressure, wherein said plug is comprised of a vitreous material which will soften at a temperature lower than the softening temperatures of the other portions of said discharge tube to enable the atmospheric pressure to drive said first electrode until said first discharge surface comes in contact with said second discharge surface, when said discharge tube is overheated due to abnormal operating conditions, comprising the steps of:

providing a metallic enclosure having at least one discharge electrode;

providing a plug made from a vitreous material having a discharge electrode through its center;

pumping and filling the tube with a controlled atmosphere;

positioning the vitreous plug relative to the enclosure to provide a predetermined interelectrode gap resulting in a corresponding tube breakdown voltage; and sealing the tube by bonding the vitreous plug with the metallic enclosure.

* * * * *